US011592758B2

(12) United States Patent
Katsumata

(10) Patent No.: US 11,592,758 B2
(45) Date of Patent: Feb. 28, 2023

(54) PHOTOSENSITIVE MEMBER UNIT CAPABLE OF PREVENTING A PHOTOSENSITIVE MEMBER AND A CHARGING ROLLER FROM ACCIDENTALLY BEING RELEASED FROM A SEPARATION STATE

(71) Applicant: CANON KABUSHIKI KAISHA, Tokyo (JP)

(72) Inventor: Go Katsumata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/529,077

(22) Filed: Nov. 17, 2021

(65) Prior Publication Data

US 2022/0163903 A1 May 26, 2022

(30) Foreign Application Priority Data

Nov. 26, 2020 (JP) ..... JP2020-196418
Sep. 22, 2021 (JP) ..... JP2021-154031

(51) Int. Cl.
*G03G 15/02* (2006.01)

(52) U.S. Cl.
CPC ..... *G03G 15/0225* (2013.01)

(58) Field of Classification Search
CPC ..... G03G 15/0216; G03G 15/0225
USPC ..... 399/100, 176
See application file for complete search history.

(56) References Cited

U.S. PATENT DOCUMENTS

| | | | | |
|---|---|---|---|---|
| 7,865,115 | B2 * | 1/2011 | Oguma et al. ..... | G03G 15/0216 399/167 |
| 9,002,234 | B2 * | 4/2015 | Shirayanagi ..... | G03G 21/1814 399/176 |
| 9,760,059 | B2 * | 9/2017 | Katayama ..... | G03G 21/1814 |
| 10,761,447 | B2 * | 9/2020 | Yamamoto ..... | G03G 15/0216 |
| 2016/0216688 | A1 | 7/2016 | Katayama | |
| 2022/0121135 | A1 * | 4/2022 | Katsumata ..... | G03G 15/0225 |

FOREIGN PATENT DOCUMENTS

| | | | |
|---|---|---|---|
| JP | H1195532 | A | 4/1999 |
| JP | 2016133776 | A | 7/2016 |
| JP | 2020052164 | A | 4/2020 |
| JP | 2020101592 | A | 7/2020 |

* cited by examiner

*Primary Examiner* — William J Royer
(74) *Attorney, Agent, or Firm* — Canon U.S.A., Inc. I.P. Division

(57) ABSTRACT

A photosensitive member unit includes a photosensitive member, a charging roller, a charging roller bearing member, a gear, a separation member having an engagement portion, a guide portion, and a frame to support the photosensitive member. The guide portion guides the charging roller bearing member urged by a urging member to separate the charging roller from the photosensitive member in a state where the engagement portion and the gear are engaged with each other and guides the charging roller bearing member urged by the urging member so that the charging roller comes into contact with the photosensitive member in a state where the engagement portion and the gear are not engaged. A distance between the urged charging roller bearing member and the frame is less than a length in which the engagement portion and the gear are engaged in the state where the engagement portion and the gear are engaged.

3 Claims, 15 Drawing Sheets

PHOTOSENSITIVE MEMBER UNIT CAPABLE OF PREVENTING A PHOTOSENSITIVE MEMBER AND A CHARGING ROLLER FROM ACCIDENTALLY BEING RELEASED FROM A SEPARATION STATE

BACKGROUND

Field

The present disclosure relates to a photosensitive member unit mountable on an image forming apparatus using an electrophotographic process.

Description of the Related Art

An electrophotographic type image forming apparatus employing a method of exchanging photosensitive member units in each of which a photosensitive member, a charging roller for charging the photosensitive member, and the like are integrated in order to facilitate maintenance, are known. Further, the image forming apparatus employing the above-described method often employs a contact charging method for charging a photosensitive member by bringing a charging roller having an elastic layer into contact with the photosensitive member by an urging force of a spring and the like.

In the above-described contact charging method, if a photosensitive member unit is left in a state of a charging roller and a photosensitive member being in contact with each other for a long period of time, a part of the charging roller being in contact with the photosensitive member may be deformed, and an image defect may be caused when an image is formed.

In order to reduce such an image defect, a configuration is known in which a photosensitive member unit is shipped with a spacer sandwiched between a photosensitive member and a charging roller, and is mounted on an image forming apparatus main body after removing the spacer.

However, in this configuration, there is an issue that it takes time and effort by a user for removing the spacer at the time of mounting the photosensitive member unit on an image forming apparatus main body.

In this regard, Japanese Patent Application Laid-Open No. 11-95532 discusses a configuration in which a photosensitive member rotates to bring a separated charging roller to come into contact with the photosensitive member without a user removing a spacer at a time of mounting a photosensitive member unit on an image forming apparatus main body. More specifically, in this configuration, the photosensitive member and the charging roller are separated from each other in a state where a fan-shaped engagement portion provided on a leading edge of a separation member attached to a rotating shaft of the charging roller engages with a photosensitive member gear coaxially provided with the photosensitive member. If the separation member is rotated by rotation of the photosensitive member, the photosensitive member gear and the separation member are disengaged, and thus the photosensitive member comes into contact with the charging roller.

However, with the configuration discussed in Japanese Patent Application Laid-Open No. 11-95532, the photosensitive member may be rotated caused by vibration applied to the photosensitive member unit during a period between when the photosensitive member unit is shipped and when it is mounted on the image forming apparatus main body, for example, during transportation. Accordingly, there is a possibility that the separation member may be removed by the rotation of the photosensitive member, and the photosensitive member and the charging roller may accidentally come into contact with each other.

United States Patent Application Publication No. 2016/0216688 discusses a configuration in which an engagement portion of a separation member is engaged with and also pressed against a gear of a photosensitive member when the photosensitive member and a charging roller are separated from each other. In this configuration, the engagement portion is pressed against the gear, so that the gear is hard to rotate.

However, there is a case where a strong vibration is applied to the photosensitive member unit before the photosensitive member unit is mounted on the image forming apparatus main body, and the separation member may move together with the charging roller in a direction away from the photosensitive member. As a result, with the configuration discussed in United States Patent Application Publication No. 2016/0216688, there is a possibility that, in a case where a force is applied in the direction for moving the separation member together with the charging roller away from the photosensitive member, and the engagement portion is separated from the gear of the photosensitive member, the separation member, which has become freely rotatable, rotates, and a separation state may be released.

SUMMARY

Disclosed is a photosensitive member unit capable of preventing a photosensitive member and a charging roller from accidentally being released from a separation state even in a case where a force for moving an engagement portion of a separation member is applied in a direction away from a photosensitive member gear in a state where the photosensitive member and the charging roller are separated from each other by engagement of the engagement portion of the separation member and the photosensitive member gear.

According to an aspect of the present disclosure, a photosensitive member unit mountable onto an image forming apparatus includes a photosensitive member that is rotatable, a charging roller that is rotatable and configured to charge the photosensitive member by coming into contact with the photosensitive member, a charging roller bearing member attached to a rotating shaft of the charging roller and rotatably supporting the charging roller, an urging member arranged on the charging roller bearing member to urge the charging roller toward the photosensitive member, a gear arranged on an end portion of the photosensitive member in a rotating axis direction, a separation member arranged on the rotating shaft of the charging roller, including an engagement portion to engage with the gear, and configured to separate the charging roller and the photosensitive member, a guide portion configured to guide the charging roller bearing member urged by the urging member so that the charging roller is separated from the photosensitive member in a state where the engagement portion and the gear are engaged with each other and to guide the charging roller bearing member urged by the urging member so that the charging roller comes into contact with the photosensitive member in a state where the engagement portion and the gear are not engaged with each other, and a frame configured to support the photosensitive member, wherein $A<B$ is satisfied, where A is a distance between the charging roller bearing member urged by the urging member and the frame, and B is a length in which the engagement portion and the gear are engaged in the state where the engagement portion and the gear are engaged with each other.

Further features of the present disclosure will become apparent from the following description of exemplary embodiments with reference to the attached drawings.

BRIEF DESCRIPTION OF THE DRAWINGS

(FIG. 14A is a partial side view illustrating a modification example of the first exemplary embodiment. FIG. 14B is a section view illustrating a modification example of the first exemplary embodiment taken along a line V-V of FIG. 14A.)

(FIG. 15A is a partial side view illustrating a modification example of the first exemplary embodiment. FIG. 15B is a section view illustrating a modification example of the first exemplary embodiment taken along a line W-W of FIG. 15A.)

DESCRIPTION OF THE EMBODIMENTS

Figure 1:
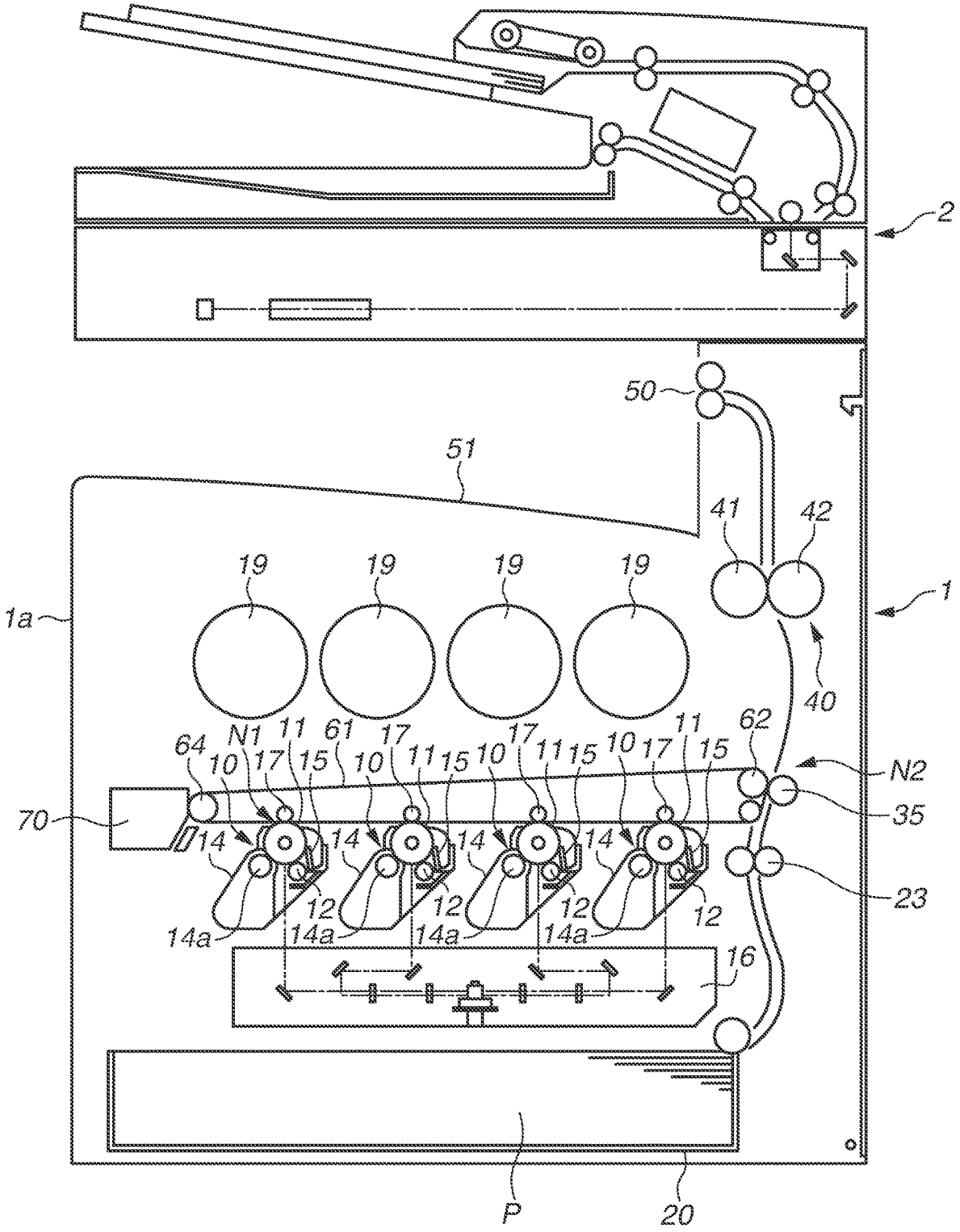
FIG. 1 is a cross-section view schematically illustrating a configuration of an image forming apparatus according to a first exemplary embodiment.

A first exemplary embodiment according to the present disclosure is described with reference to FIG. 1 to FIGS. 11A and 11B. First, a schematic configuration of an image forming apparatus according to the present exemplary embodiment is described with reference to FIG. 1.

<Image Forming Apparatus>

An image forming apparatus 1 is a tandem type image forming apparatus that employs an intermediate transfer method and capable of forming a full-color image using an electrophotographic method. Specifically, the image forming apparatus 1 has a tandem type configuration in which image forming units 10 of respective colors of yellow (y), magenta (M), cyan (C), and black (K) are arranged side by side in a rotation direction of an intermediate transfer belt 61. A configuration and an operation of each image forming unit 10 are substantially the same except that the color of used toner is different.

The image forming unit 10 includes a photosensitive drum 11, which is a cylindrical electrophotographic photosensitive member (photosensitive member). The photosensitive drum 11 is driven to rotate at a process speed (peripheral speed) of 100 mm/sec by a driving force transmitted from a driving unit (not illustrated) provided in an apparatus main body 1*a*. In the image forming unit 10, a charging roller 12, a developing device 14, a primary transfer roller 17, and a drum cleaning device 15 are arranged in this order around the photosensitive drum 11 along a rotation direction thereof. An exposure device 16 is arranged below each image forming unit 10. The image forming apparatus 1 further includes the intermediate transfer belt 61 formed with an endless belt body as an intermediate transfer member so as to come into contact with the photosensitive drum 11 of each image forming unit 10.

The charging roller 12 as a charging unit is a rotatable roller-shaped charging member, is arranged to abut on the photosensitive drum 11, and charges a surface of the photosensitive drum 11. The exposure device (laser scanner device) 16 as an exposure unit exposes the surface of the charged photosensitive drum 11 with light and forms an electrostatic latent image thereon.

The developing device 14 as a developing unit stores toner as developing agent inside thereof and develops the electrostatic latent image formed on the photosensitive drum 11 as a toner image using the toner. The developing device 14 includes a developing sleeve 14*a* as a developing agent bearing member for bearing and conveying the toner to a facing portion (developing position) to the photosensitive drum 11. The developing sleeve 14*a* is driven to rotate.

The primary transfer roller 17 as a primary transfer unit is a roller-shaped primary transfer member and primarily transfers the toner image formed on the photosensitive drum 11 to the intermediate transfer belt 61. The drum cleaning device 15 cleans transfer residual toner and the like remaining on the photosensitive drum 11 after the primary transfer.

The intermediate transfer belt 61 is formed of a dielectric resin such as polyimide in an endless shape. The intermediate transfer belt 61 is stretched around a plurality of supporting rollers (stretching rollers) with a predetermined tension. The above-described primary transfer roller 17 is arranged at a position facing each photosensitive drum 11 on an inner circumferential surface side (back surface side) of the intermediate transfer belt 61. The primary transfer roller 17 is pressed against the photosensitive drum 11 via the intermediate transfer belt 61 and forms a primary transfer portion (primary transfer nip portion) N1 at which the intermediate transfer belt 61 and the photosensitive drum 11 come into contact with each other. The primary transfer roller 17 rotates following the rotation of the intermediate transfer belt 61.

A secondary transfer roller 35, which is a roller-shaped secondary transfer member as a secondary transfer unit, is arranged at a position facing a secondary transfer counter roller 62 on an outer circumferential surface side (front surface side) of the intermediate transfer belt 61. The secondary transfer roller 35 is pressed against the secondary transfer counter roller 62 via the intermediate transfer belt 61, and forms a secondary transfer portion (secondary transfer nip portion) N2 at which the intermediate transfer belt 61 and the secondary transfer roller 35 come into contact with each other. The toner image transferred onto the intermediate transfer belt 61 is secondarily transferred to a recording material P at the secondary transfer portion N2.

A belt cleaning device 70 as an intermediate transfer member cleaning unit is arranged at a position facing a tension roller 64 on the outer circumferential surface side of the intermediate transfer belt 61.

The belt cleaning device 70 cleans the transfer residual toner and the like remaining on the intermediate transfer belt 61 after the secondary transfer.

Next, an image forming operation is described. At the time of image formation, the surface of the photosensitive drum 11 to be driven to rotate is uniformly charged to a predetermined potential with a predetermined polarity by the charging roller 12. According to the present exemplary embodiment, only a direct current (DC) voltage of −1300V is applied to the charging roller 12 from a not-illustrated high-voltage power supply (charging power supply), and discharge occurs onto the surface of the photosensitive drum 11, so that the surface of the photosensitive drum 11 is charged to approximately −700V.

After the surface of the photosensitive drum 11 is uniformly charged, the surface of the photosensitive drum 11 is scanned and exposed with light by the exposure device 16 based on a signal of image information, and an electrostatic latent image (electrostatic image) is formed on the photosensitive drum 11. The image forming apparatus 1 according to the present exemplary embodiment includes an image reading apparatus 2, and the above-described image information includes image information about a document read by the image reading apparatus 2 and image information transmitted from an external terminal such as a personal computer connected to the image forming apparatus 1.

The electrostatic latent image formed on the photosensitive drum 11 is developed by the developing device 14 as a toner image using the toner as the developing agent. According to the present exemplary embodiment, a normal charge polarity of the toner is a negative polarity. At the time of development, a predetermined development voltage (development bias) is applied to the developing sleeve 14*a* from a high-voltage power supply as a development power supply (not illustrated). As the development voltage, a vibration voltage is used in which a DC voltage (DC component) and an alternating current (AC) voltage (AC component) are overlapped. The developing device 14 is supplied with the toner from a toner bottle 19 as a toner storage container via a toner conveyance path (not illustrated).

The toner image formed on the photosensitive drum 11 is transferred (primarily transferred) onto a surface of the intermediate transfer belt 61 at the primary transfer portion N1 by an action of the primary transfer roller 17. At that time, a primary transfer voltage (primary transfer bias), which is a DC voltage having a polarity opposite to the charge polarity of the toner at the time of development (positive polarity according to the present exemplary embodiment), is applied to the primary transfer roller 17 from a not-illustrated primary transfer power supply (high-voltage power supply). At the time of forming a full-color image, the above-described operations are performed in each image forming unit 10, and the toner images of yellow, magenta, cyan, and black formed on the respective photosensitive drums 11 are transferred onto the intermediate transfer belt 61 to be sequentially overlapped on each other.

After the transfer, a small amount of the transfer residual toner remaining on the photosensitive drum 11 is removed by the drum cleaning device 15 and collected into a collection portion 15*b*.

On the other hand, the recording material P is fed one by one from a sheet feeding cassette 20 and conveyed to a registration roller pair 23. The recording material P is a sheet such as a paper sheet and a plastic sheet. Then, the registration roller pair 23 conveys the recording material P to between the intermediate transfer belt 61 and the secondary transfer roller 35 in synchronization with the toner image on the intermediate transfer belt 61.

The color toner image on the intermediate transfer belt 61 is transferred (secondarily transferred) to a surface of the recording material P at the secondary transfer portion N2 by an action of the secondary transfer roller 35. When the recording material P passes through the secondary transfer portion N2, a secondary transfer voltage (secondary transfer bias), which is a DC voltage having a polarity opposite to the charge polarity of the toner at the time of development, is applied to the secondary transfer roller 35 from a not-illustrated secondary transfer power supply (high-voltage power supply). After the transfer, a small amount of the residual toner remaining on the intermediate transfer belt 61 is removed and collected by the belt cleaning device 70, and the intermediate transfer belt 61 prepares for next image formation again.

The toner image transferred onto the recording material P is fixed by being heated and pressed at a nip portion between a heating roller 41 and a pressing roller 42 in a fixing device 40, and the recording material P is discharged on a discharge tray 51 by a discharge roller pair 50.

<Drum Cartridge>

Figure 3:
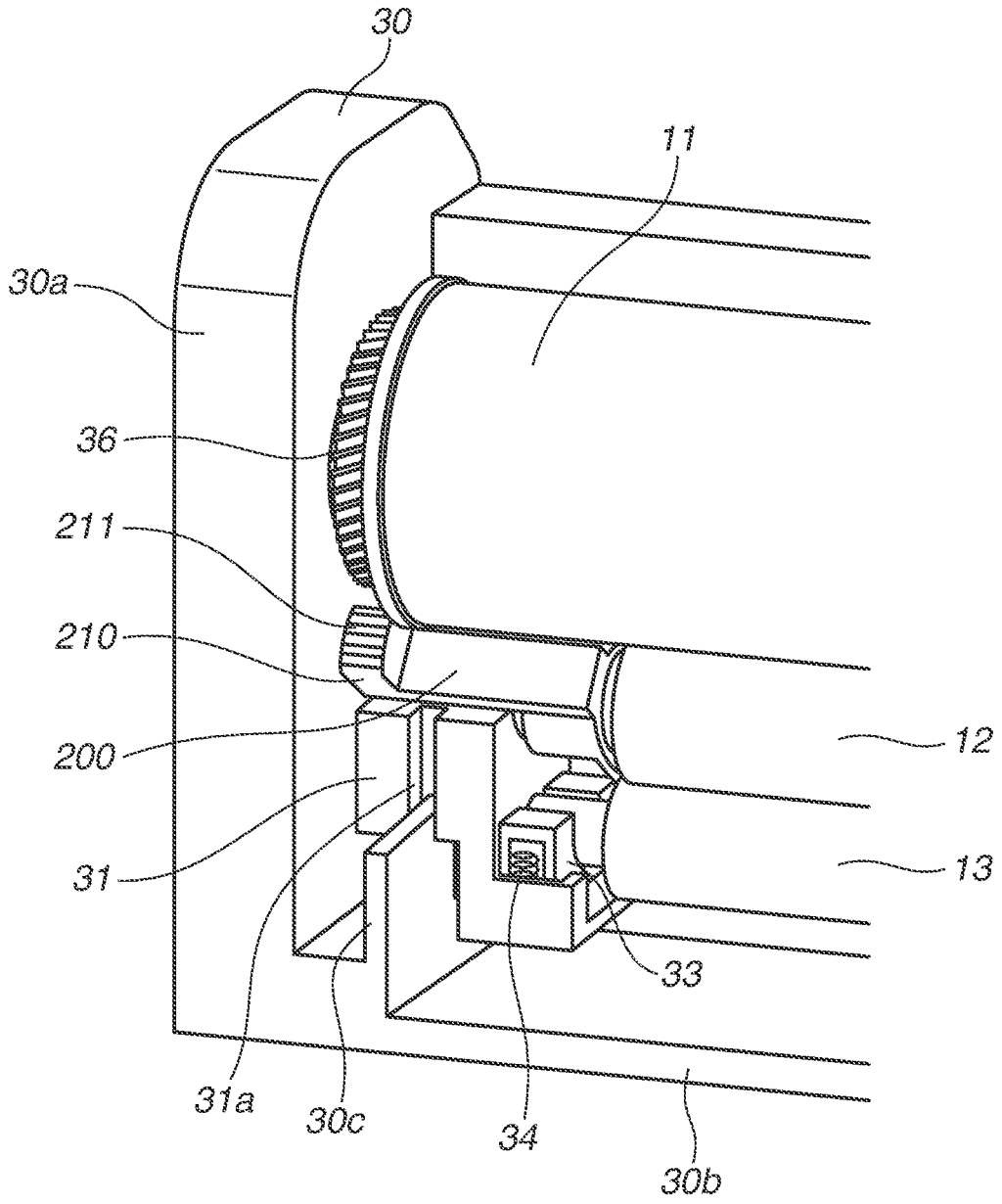
FIG. 3 is a partial perspective view illustrating a contact state of the drum unit with a regulation unit being omitted according to the first exemplary embodiment.
Figure 4:
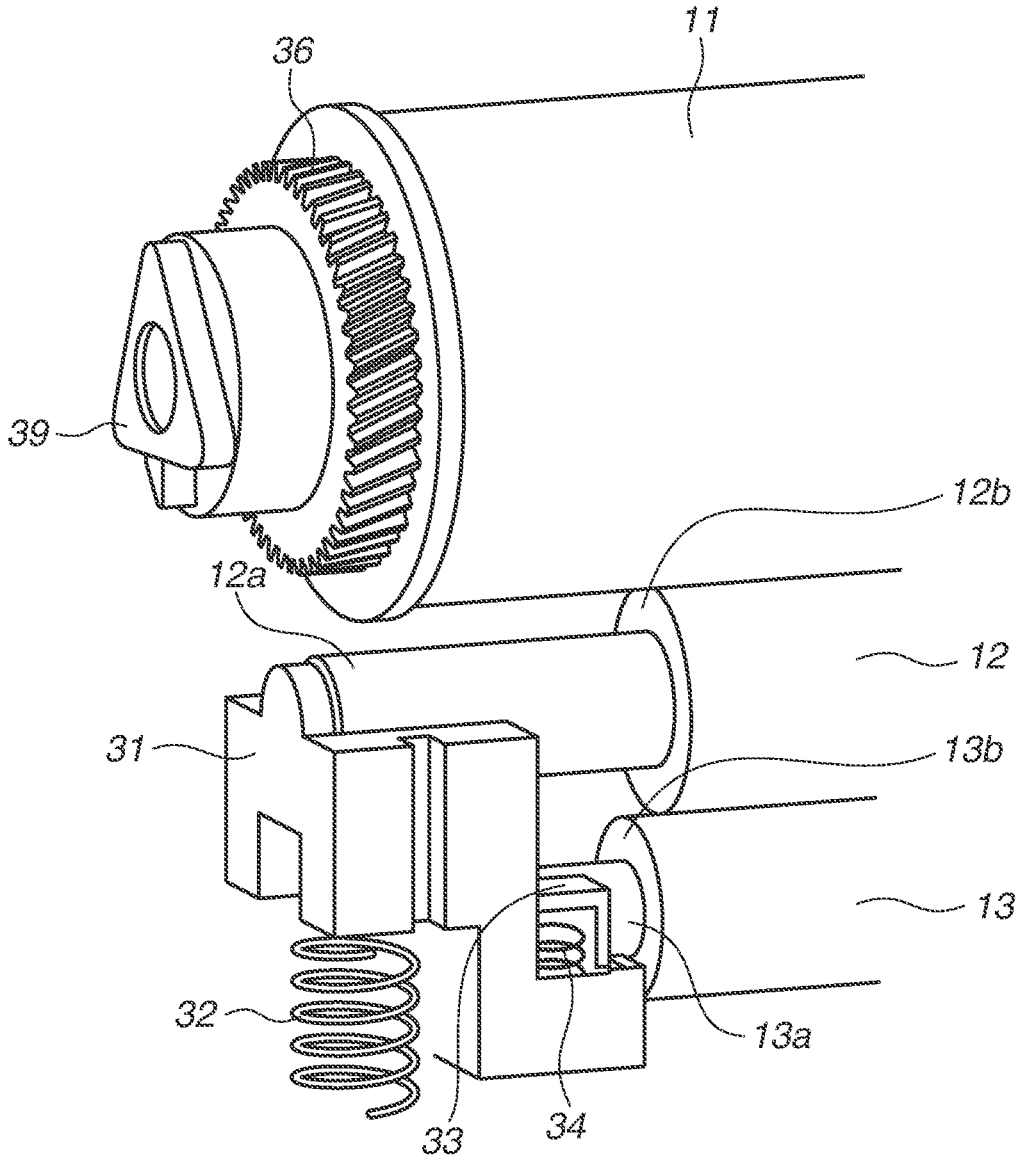
FIG. 4 is a partial perspective view illustrating the contact state of the drum unit with the regulation unit, a separation member, and a frame being omitted according to the first exemplary embodiment.
Figure 5:
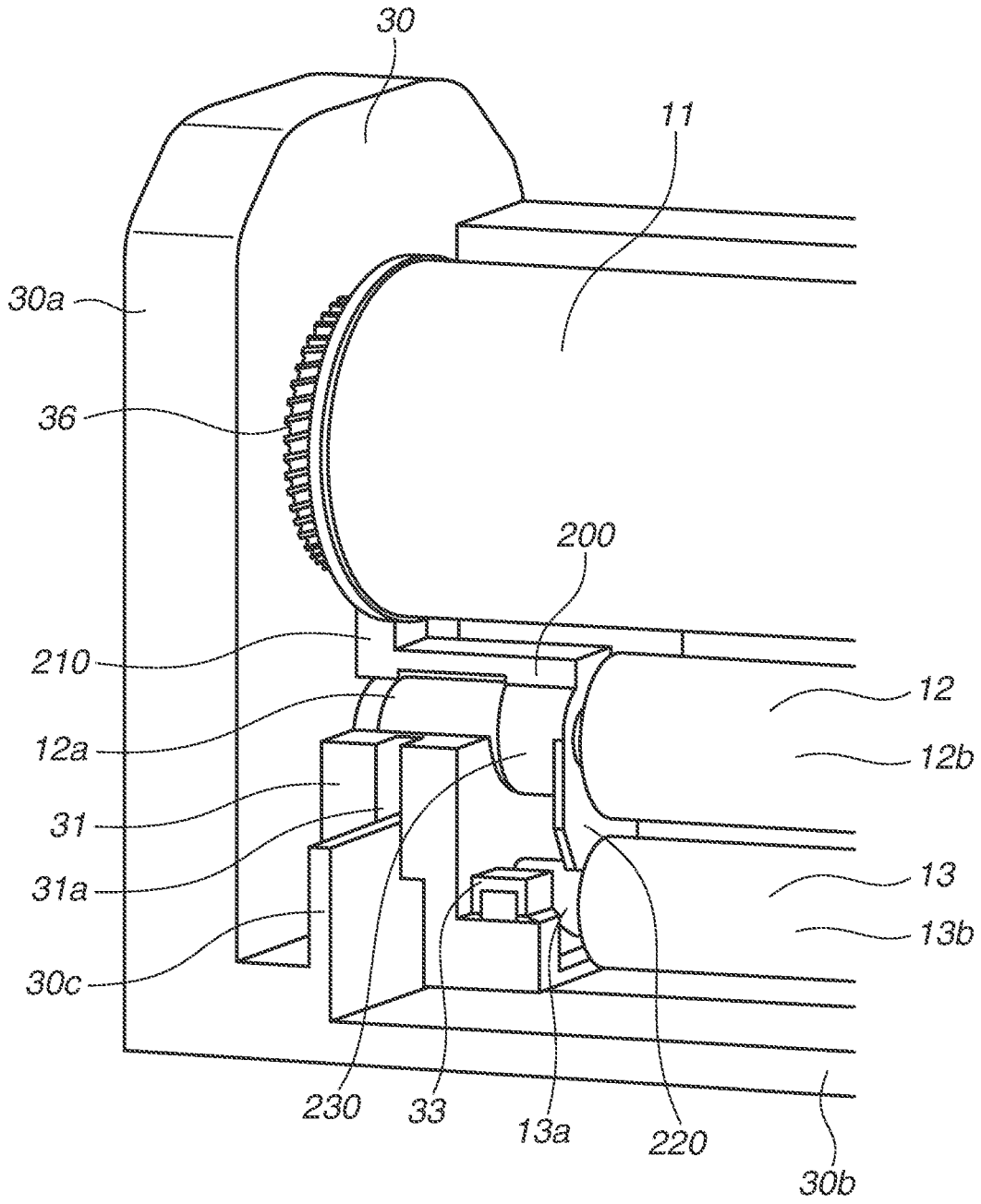
FIG. 5 is a partial perspective view illustrating a separation state of the drum unit with the regulation unit being omitted according to the first exemplary embodiment.
Figure 6:
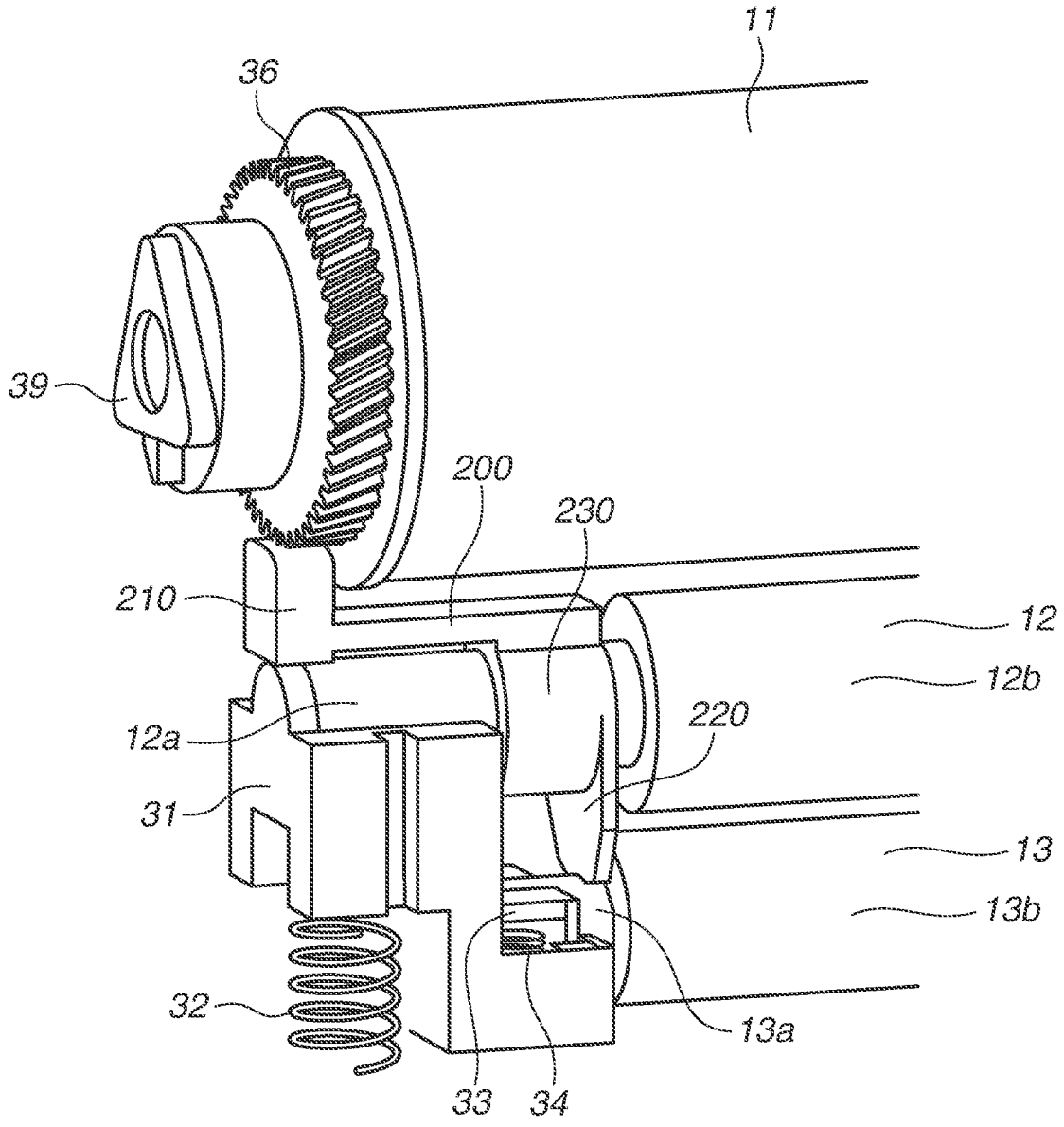
FIG. 6 is a partial perspective view illustrating the separation state of the drum unit with the regulation unit and the frame being omitted according to the first exemplary embodiment.

Next, a configuration of a drum cartridge 100 as a photosensitive member unit (drum unit) is schematically described with reference to FIGS. 2 to 4. According to the present exemplary embodiment, the drum cartridge 100 including the photosensitive drum 11 can be attached to and detached from the apparatus main body 1*a* (FIG. 1) so as to be replaceable for maintenance and the like. For example, the drum cartridge 100 can be freely attached to and detached from the apparatus main body 1*a* by moving along a longitudinal direction (rotating axis direction of the photosensitive drum 11) with respect to the apparatus main body 1*a*.

Figure 2:
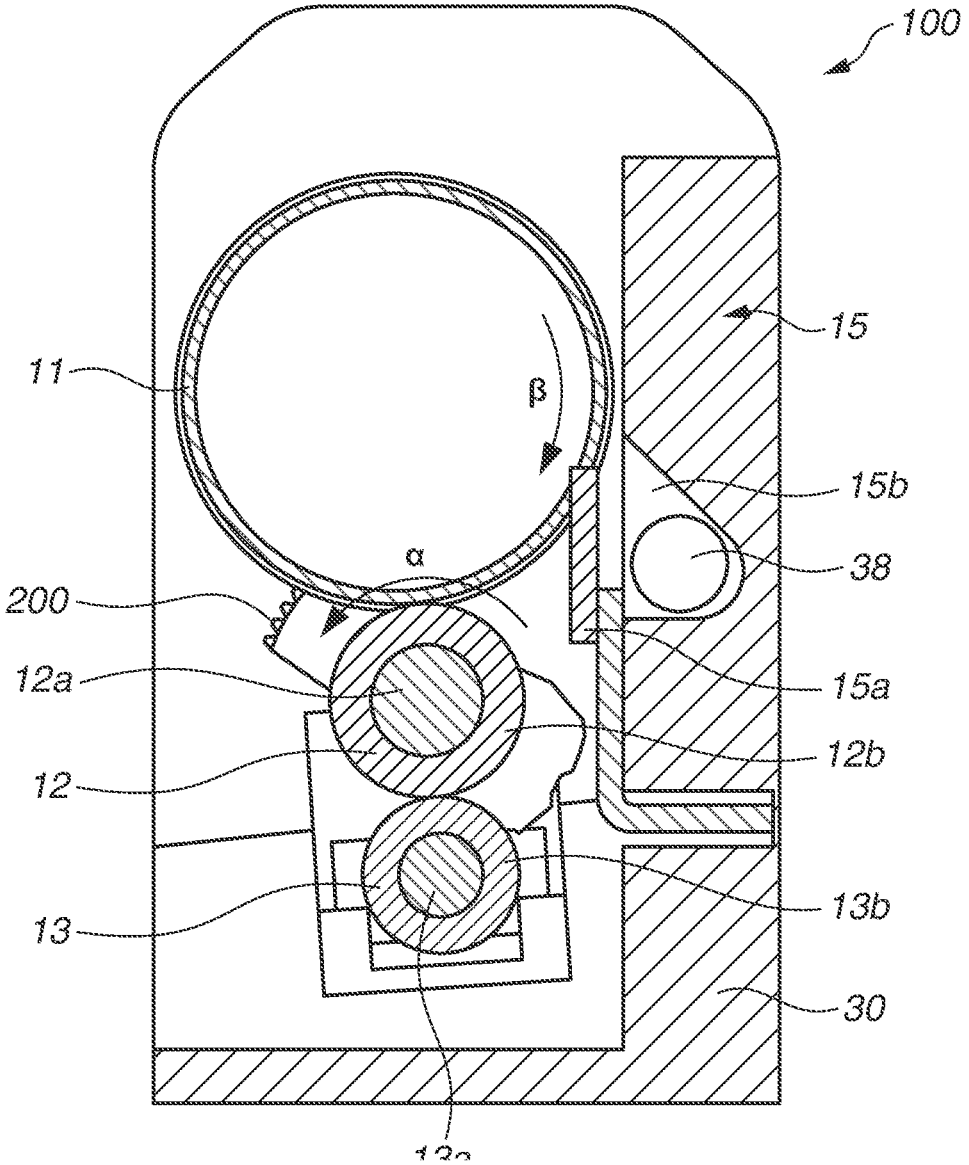
FIG. 2 is a cross-section view schematically illustrating a configuration of a drum unit according to the first exemplary embodiment.

As illustrated in FIG. 2, the drum cartridge 100 includes the photosensitive drum 11 as a photosensitive member, the charging roller 12, a cleaning roller 13 as a cleaning member, the drum cleaning device 15, and a separation member 200 made of resin. These components are integrally held by a drum container 30 as a frame.

The photosensitive drum 11 is held in the drum container 30 via a bearing (not illustrated) so as to be rotatable about a rotating axis line. In other words, as illustrated in FIG. 3, the drum container 30 includes side walls 30*a* arranged on both sides in the rotating axis direction of the photosensitive drum 11, the charging roller 12, and the cleaning roller 13 and a connection portion 30*b* connecting the side walls 30*a* on the both sides. Further, both end portions of the photosensitive drum 11 in the rotating axis direction are rotatably supported by the side walls 30*a* on the both sides in the rotating axis direction via the bearings.

The photosensitive drum 11 is provided with a coupling 39 (FIG. 4) for rotating by receiving a driving force from a motor as a driving source (not illustrated) provided on the apparatus main body 1*a* in a state of being mounted on the apparatus main body 1*a*. In a case where the drum cartridge 100 is mounted on the apparatus main body 1*a*, the coupling 39 is coupled with a coupling provided on the apparatus main body 1*a*, and the driving force is transmitted from the motor provided on the apparatus main body 1*a*.

The drum container 30 is provided with the drum cleaning device 15 that includes a cleaning blade 15*a*, the collection portion 15*b*, and a toner conveyance screw 38. The cleaning blade 15*a* is fixed to the drum container 30 and cleans the surface of the photosensitive drum 11 by abutting on the surface of the photosensitive drum 11 in a counter direction with respect to a rotation direction β of the photosensitive drum 11 at the time of image formation.

The collection portion 15*b* is arranged near the cleaning blade 15*a* and collects the transfer residual toner removed from the surface of the photosensitive drum 11 by the cleaning blade 15*a*.

The toner conveyance screw 38 as a conveyance unit conveys the toner collected by the collection portion 15*b* to the outside of the drum cartridge 100. The toner conveyed to the outside of the drum cartridge 100 by the toner conveyance screw 38 is collected to a waste toner container (not illustrated) provided in the apparatus main body 1*a*.

A gear 36 (FIGS. 3 and 4) as a rotation member fixed to integrally rotate with the photosensitive drum 11 about the rotating axis line of the photosensitive drum 11 is provided on the end portion of the photosensitive drum 11 in a longitudinal direction (end portion in the rotating axis direction). In other words, the gear 36 is provided on the rotating shaft of the photosensitive drum 11 so as to rotate together with the photosensitive drum 11. The driving force is input to the photosensitive drum 11 via the coupling 39, and the gear 36 rotates integrally with the photosensitive drum 11. The rotational force of the gear 36 is transmitted to the toner conveyance screw 38. In this way, the toner conveyance screw 38 is rotated, and the transfer residual toner collected in the collection portion 15*b* can be conveyed to the outside of the drum cartridge 100.

The charging roller 12 as a charging member is a roller-shaped member including a rotating shaft 12*a* as a conductive supporting body (core metal or core material) and one or more elastic layers 12*b* formed around the rotating shaft 12*a*. The charging roller 12 is brought into contact with the surface of the photosensitive drum 11 at a predetermined pressing force by a pressing spring 32 (FIG. 4) as a first urging member and is driven to rotate by the rotation of the photosensitive drum 11.

The configuration is described more specifically. The rotating shaft 12*a* of the charging roller 12 is held by a charging roller bearing 31 as a roller holding portion, and thus the charging roller 12 is supported to be rotatable. The charging roller bearing 31 is supported to be slidable with respect to the drum container 30. More specifically, the charging roller bearing 31 is guided by a slide guide portion 30*c* provided on the drum container 30 to be slidable in a direction toward the rotating axis line of the photosensitive drum 11. In the illustrated example, a groove 31*a* is formed on the charging roller bearing 31 along a slide direction thereof, and the slide guide portion 30*c* engages with the groove 31*a*, so that the charging roller bearing 31 is guided in the direction toward the rotating axis line of the photosensitive drum 11.

The charging roller 12 supported by the charging roller bearing 31 can move along the direction toward the rotating axis line of the photosensitive drum 11 on a surface perpendicular to the rotating axis line of the photosensitive drum 11. In this way, the charging roller 12 is provided to be movable between a contact position at which the charging roller 12 comes into contact with the surface of the photosensitive drum 11 and a separation position at which the charging roller 12 is separated from the surface of the photosensitive drum 11. Further, the charging roller 12 is applied with a voltage at the contact position and thus charges the surface of the photosensitive drum 11.

Further, the pressing spring 32 as the first urging member is provided between the drum container 30 and the charging roller bearing 31. The pressing spring 32 urges the charging roller 12 in the direction toward the rotating axis line of the photosensitive drum 11 (urging direction of the pressing spring 32) on the surface perpendicular to the rotating axis line of the photosensitive drum 11. In other words, the pressing spring 32 urges the charging roller bearing 31 in the same direction as the slide direction of the charging roller bearing 31. Thus, the charging roller 12 is pressed and comes into contact with the photosensitive drum 11. In this way, the pressing spring 32 urges the charging roller 12 in a direction from the separation position toward the contact position.

The cleaning roller 13 as the cleaning member comes into contact with the charging roller 12 and cleans a surface of the charging roller 12. The cleaning roller 13 is a roller-shaped member including a rotating shaft 13*a* as a rod-shaped supporting portion (core metal or core material) and an elastic layer 13*b* formed around the rotating shaft 13*a*, and comes into contact with the charging roller 12 on an outer circumferential surface thereof. The cleaning roller 13 is brought into contact with the surface of the charging roller 12 at a predetermined pressing force by a pressing spring 34 (FIGS. 3 and 4) as a second urging member and is driven to rotate following the rotation of the charging roller 12.

The configuration is described more specifically. The rotating shaft 13*a* of the cleaning roller 13 is supported by a cleaning roller bearing 33, and thus the cleaning roller 13 is supported to be rotatable. Further, the cleaning roller bearing 33 is supported to be slidable with respect to the charging roller bearing 31. More specifically, the cleaning roller bearing 33 is configured to be slidable in a direction toward the rotating axis line of the charging roller 12 so that the cleaning roller 13 can move along the direction toward the rotating axis line of the charging roller 12 on a surface perpendicular to the rotating axis line of the charging roller 12. In the present exemplary embodiment, the rotating axis line of the charging roller 12 and a rotating axis line of the separation member 200 described below are in common.

In this way, the cleaning roller 13 is provided to be movable between a roller contact position at which the cleaning roller 13 comes into contact with the surface of the charging roller 12 and a roller separation position at which the cleaning roller 13 is separated from the surface of the charging roller 12.

The cleaning roller 13 cleans the charging roller 12 at the roller contact position.

Further, the pressing spring 34 as the second urging member is provided between the charging roller bearing 31 and the cleaning roller bearing 33. The pressing spring 34 urges the cleaning roller 13 in a direction toward the rotating axis direction of the charging roller 12 (urging direction) on the surface perpendicular to the rotating axis line of the charging roller 12. Thus, the cleaning roller 13 is pressed and comes into contact with the charging roller 12. In this way, the pressing spring 34 urges the cleaning roller 13 in a direction from the roller separation position toward the roller contact position. In other words, the cleaning roller 13 is supported by the cleaning roller bearing 33 to be movable along the urging direction of the pressing spring 34. Further, in the present exemplary embodiment, the urging direction of the pressing spring 32 and the urging direction of the pressing spring 34 are substantially the same direction.

The cleaning roller 13 is supported by the charging roller bearing 31 via the cleaning roller bearing 33 and the pressing spring 34. Thus, as described below, in a case where the charging roller 12 is moved in a direction away from the photosensitive drum 11 by the separation member 200, the cleaning roller 13 moves in a movement direction of the charging roller 12 interlocking with this movement.

With the above-described configuration, if the photosensitive drum 11 is rotated by receiving the driving force from the driving source such as a motor provided in the apparatus main body 1*a*, the charging roller 12 is driven to rotate by a frictional force with the photosensitive drum 11. Further, if the charging roller 12 is rotated, the cleaning roller 13 is driven to rotate by a frictional force with the charging roller 12. In addition, the toner conveyance screw 38 is rotated by receiving the driving force (rotational force) from the gear 36.

<Separation Member>

Next, the separation member 200 is described with reference to FIG. 3 to FIGS. 7A and 7B. In FIGS. 3 to 7B, a regulation unit 300, shown in FIG. 8, to be described below is omitted. First, a separation maintaining configuration that maintains the photosensitive drum 11 and the charging roller 12, and also the charging roller 12 and the cleaning roller 13 in a separation state by the separation member 200 is described with reference to FIGS. 5, 6, and 7A.

<Separation Maintaining Configuration>

The drum cartridge 100 is provided with the separation member 200 for separating the charging roller 12 from the photosensitive drum 11 and the charging roller 12 from the cleaning roller 13 to secure clearances therebetween during the transportation for distribution.

The separation member 200 is provided on the rotating shaft 12*a* of the charging roller 12 to be freely swingable. In the present exemplary embodiment, the separation members 200 are provided on both ends of the rotating shaft 12*a* of the charging roller 12 to be swingable with the rotating shaft 12*a* as a swing shaft. In other words, the separation member 200 is supported by the charging roller 12 to be swingable about the rotating axis line of the charging roller 12. Thus, the separation member 200 can move interlocking with a movement of the charging roller 12. The configurations of the separation members 200 on the both ends of the charging roller 12 are the same, so that the following description is made with reference to the drawings illustrating only one side.

The separation member 200 includes two separation maintaining portions 210 and 220 and a swing supporting portion 230. The swing supporting portion 230 is fit to the rotating shaft 12*a* of the charging roller 12 to be freely swingable as described above. In this way, the separation member 200 is supported to be freely swingable with respect to the rotating shaft 12*a*. The separation maintaining portion 210 is arranged between the gear 36 provided on the photosensitive drum 11 and the rotating shaft 12*a* of the charging roller 12, separates the photosensitive drum 11 and the charging roller 12, and secures the clearance therebetween. The separation maintaining portion 220 is arranged between the rotating shaft 12*a* of the charging roller 12 and the rotating shaft 13*a* of the cleaning roller 13, separates the charging roller 12 and the cleaning roller 13, and secures the clearance therebetween.

The two separation maintaining portions 210 and 220 and the swing supporting portion 230 are integrally formed. Accordingly, in a state where the separation member 200 is located in a first phase with respect to a swing direction, the separation maintaining portions 210 and 220 respectively maintain the photosensitive drum 11 and the charging roller 12, and the charging roller 12 and the cleaning roller 13 in the separation state (separation maintaining state). On the other hand, in a case where the separation member 200 swings from the first phase to a second phase with respect to the swing direction, the separation maintaining state between the photosensitive drum 11 and the charging roller 12 and the separation maintaining state between the charging roller 12 and the cleaning roller 13 are released at the same time (separation released state) as described below.

In the separation maintaining state of the photosensitive drum 11 and the charging roller 12, the separation maintaining portion 210 is sandwiched between the rotating shaft 12*a* of the charging roller 12 (rotating shaft of the separation member 200) and the gear 36 by the pressing force (urging force) of the pressing spring 32. Further, in the separation maintaining state of the charging roller 12 and the cleaning roller 13, the separation maintaining portion 220 is sandwiched between the rotating shaft 13*a* of the cleaning roller 13 and the rotating shaft 12*a* of the charging roller 12 by the pressing force (urging force) of the pressing spring 34.

Figure 7A:
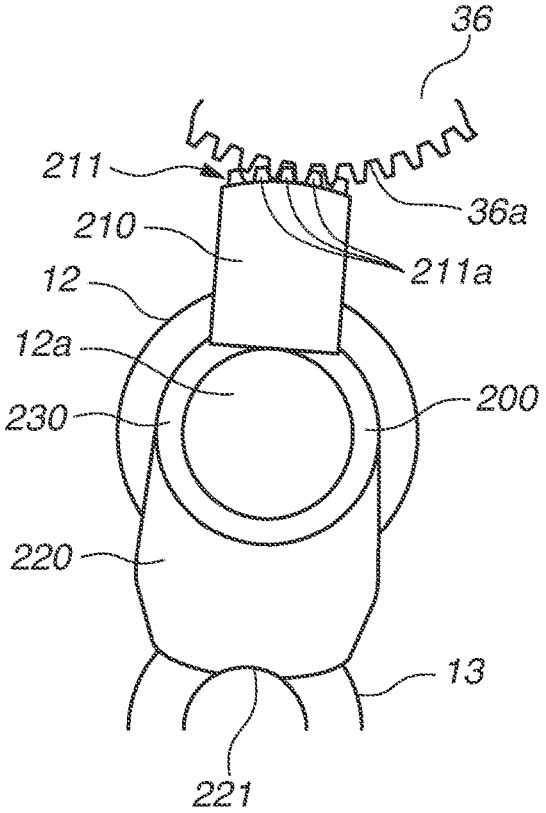
FIGS. 7A and 7B are schematic cross-section views respectively illustrating the separation state and a separation released state of the separation member according to the first exemplary embodiment.

As illustrated in FIG. 7A, the separation maintaining portion 210 of the separation member 200 includes an engagement portion 211 that can engage with the gear 36. The engagement portion 211 includes gear teeth 211*a* as engagement convex portions formed on a side surface of the separation maintaining portion 210 facing the gear 36 in the separation maintaining state. Further, engagement concave portions 36*a* that can engage with the gear teeth 211*a* are formed on an entire circumference of an outer circumferential surface of the gear 36. In other words, the engagement concave portion 36*a* is formed between gear teeth of the gear 36. The gear teeth 211*a* are formed at the same pitch as that of the engagement concave portions 36*a* of the gear 36 (pitch of the gear teeth of the gear 36). Further, in the separation maintaining state where the photosensitive drum 11 and the charging roller 12 are separated, the gear teeth 211*a* of the engagement portion 211 engage with the engagement concave portions 36*a* of the gear 36. The separation member 200 maintains the charging roller 12 in the separation position at which the photosensitive drum 11 and the charging roller 12 are separated against the urging force of the pressing spring 32 in a state where the engagement portion 211 engages with the gear 36 as the rotation member.

The separation maintaining portion 220 of the separation member 200 includes an engagement portion 221 as a cleaning member engagement portion that can engage with the rotating shaft 13*a* of the cleaning roller 13 as a part of the cleaning member. The engagement portion 221 is a concave portion provided on a side surface of the separation maintaining portion 220 facing the rotating shaft 13*a* in the separation maintaining state and has a curvature radius substantially the same as an outer diameter of an outer circumferential surface of the cylindrical rotating shaft 13*a*. Further, the engagement portion 221 engages with the rotating shaft 13*a* in the separation maintaining state where the charging roller 12 and the cleaning roller 13 are separated. In other words, at that time, the separation member 200 maintains the cleaning roller 13 at the separation position at which the charging roller 12 and the cleaning roller 13 are separated against the urging force of the pressing spring 34 in a state where the engagement portion 221 engages with the rotating shaft 13*a* as a part of the cleaning member.

The engagement portion 221 of the separation maintaining portion 220 is formed to engage with the rotating shaft 13*a* of the cleaning roller 13 in the state where the engagement portion 211 of the separation maintaining portion 210 engages with the gear 36. Thus, in the state where the separation member 200 is located in the first phase with respect to the swing direction, the engagement portions 211 and 221 respectively engage with the gear 36 and the rotating shaft 13*a*. Further, the engagement portions 211 and 221 respectively maintain the charging roller 12 and the cleaning roller 13 in the separation state. In this way, for example, at the time of transportation of the drum cartridge 100, the elastic layer 12*b* of the charging roller 12 and the photosensitive drum 11, and the charging roller 12 and the cleaning roller 13 are separated, and the clearances therebetween are respectively secured.

<Separation Releasing Configuration>

Figure 7B:
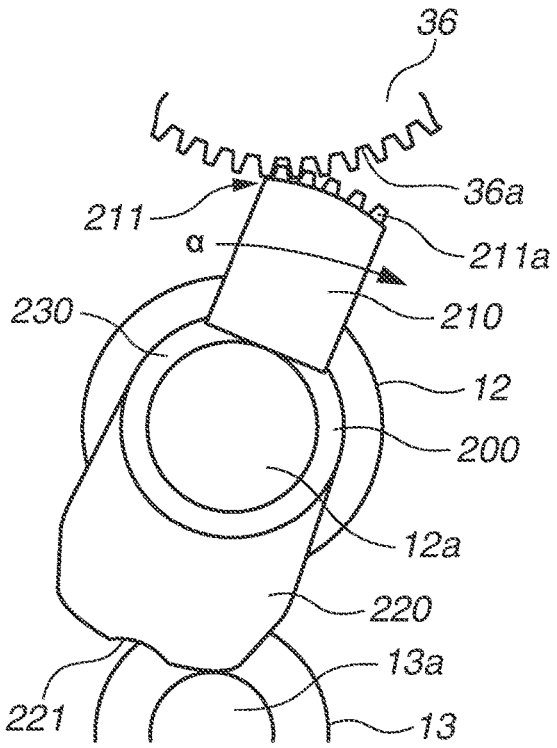

Next, a separation releasing configuration for releasing the separation maintaining state of the photosensitive drum 11 and the charging roller 12 and of the charging roller 12 and the cleaning roller 13 by the separation member 200 is described with reference to FIGS. 3, 4 and 7B. In a case where a new drum cartridge 100 is mounted on the apparatus main body 1*a* (FIG. 1), and the image forming apparatus 1 (FIG. 1) is started, a driving force (rotational force) is input to the photosensitive drum 11 from the motor provided in the apparatus main body 1*a* by an initial operation performed by the image forming apparatus 1.

When the drum cartridge 100 is mounted on the apparatus main body 1*a*, the photosensitive drum 11 and the charging roller 12, and the charging roller 12 and the cleaning roller 13 are separated, i.e., in the separation maintaining state as illustrated in FIG. 7A. If the rotation of the photosensitive drum 11 is started from the separation maintaining state, the gear 36 rotates following the rotation of the photosensitive drum 11 as illustrated in FIG. 7B. Then, the engagement portion 211 engaging with the gear 36 receives the rotational force of the gear 36, and the separation member 200 swings in a predetermined direction α (an arrow direction in FIG. 7B).

The separation member 200 swings in the predetermined direction a as described above, so that the engagement portion 211 and the gear 36 are disengaged, and the separation maintaining portion 210 is released from the state of being sandwiched between the rotating shaft 12*a* of the charging roller 12 (swing shaft of the separation member 200) and the gear 36. As a result, a state where the charging roller 12 is maintained in the separation position is automatically released. In other words, the charging roller 12 abuts on the photosensitive drum 11. The separation member 200 is configured in such a manner that the engagement portion 211 and the gear 36 are not disengaged in a case where the separation member 200 swings in a direction opposite to the predetermined direction α.

Further, the separation member 200 swings in the predetermined direction α, so that the engagement portion 221 and the rotating shaft 13*a* of the cleaning roller 13 are disengaged, and the separation maintaining portion 220 is released from the state of being sandwiched between the rotating shaft 12*a* of the charging roller 12 and the rotating shaft 13*a* of the cleaning roller 13. As a result, a state where the cleaning roller 13 is maintained in the roller separation position is automatically released. In this way, according to the present exemplary embodiment, if the drum cartridge 100 is mounted on the apparatus main body 1*a*, and then the gear 36 is rotated by the initial operation of the image forming apparatus 1, the separation member 200 swings in the predetermined direction α, and the separation maintaining states of the charging roller 12 and the cleaning roller 13 are automatically released at the same time.

<Movement Regulation of Separation Member>

Next, a configuration that can prevent the engagement portion 211 of the separation member 200 and the gear 36 from being accidentally disengaged even if a strong vibration is applied to the drum cartridge 100, for example, during transportation of the drum cartridge 100, is described with reference to FIG. 8 to FIGS. 11A and 11B. According to the present exemplary embodiment, the regulation unit 300 as a regulation unit prevent the engagement portion 211 of the separation member 200 and the gear 36 from being accidentally disengaged. More specifically, the regulation unit 300 regulates a movement of the separation member 200 in a direction in which a distance between a swing center of the separation member 200 and a rotation center of the gear 36 increases (direction in which the charging roller bearing 31 is guided along the slide guide portion 30*c*) so that the engagement portion 211 and the gear 36 are not disengaged in the state in which the engagement portion 211 engages with the gear 36.

Figure 8:
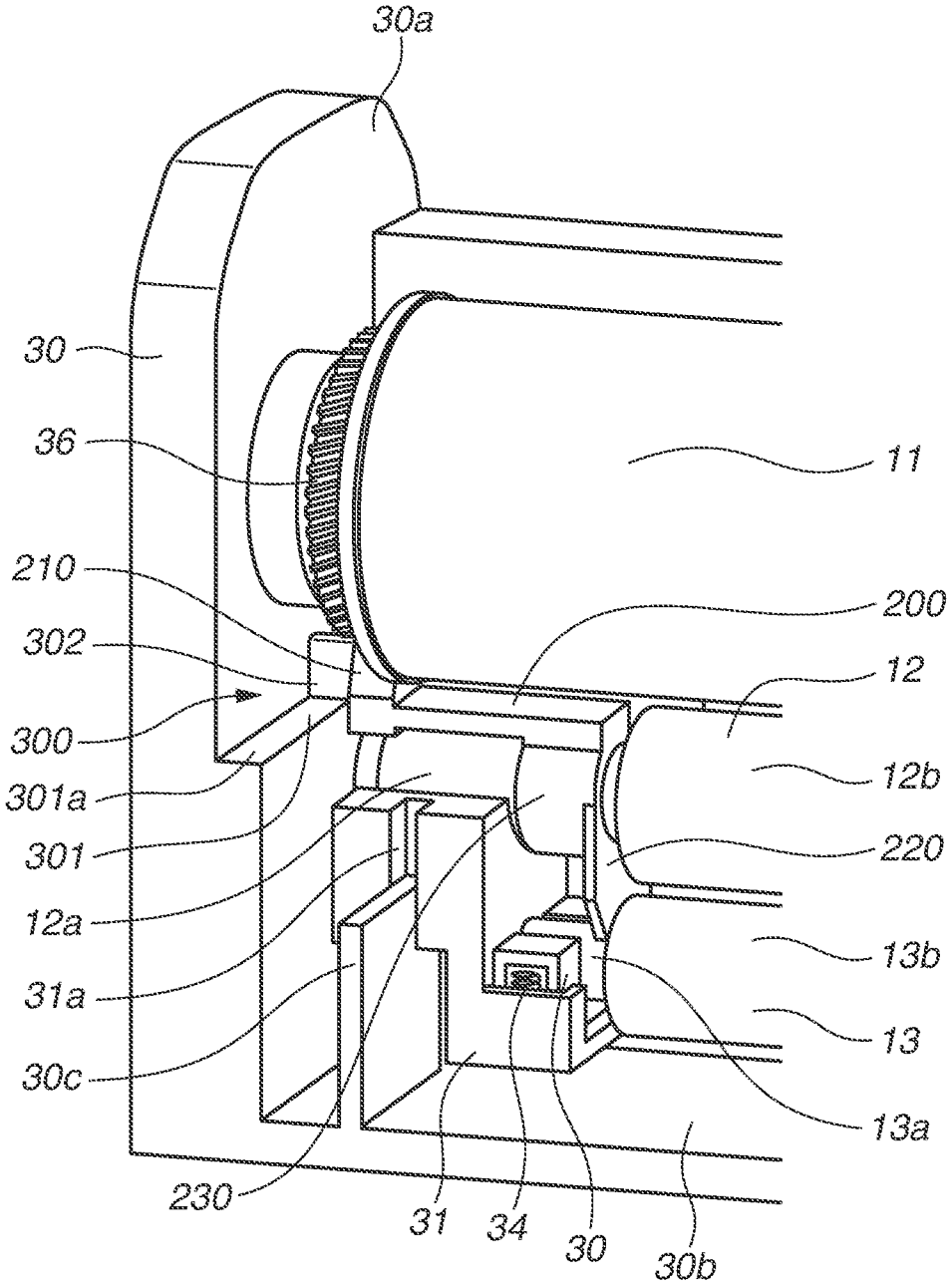
FIG. 8 is a partial perspective view illustrating the separation state of the drum unit according to the first exemplary embodiment.
Figure 9A:
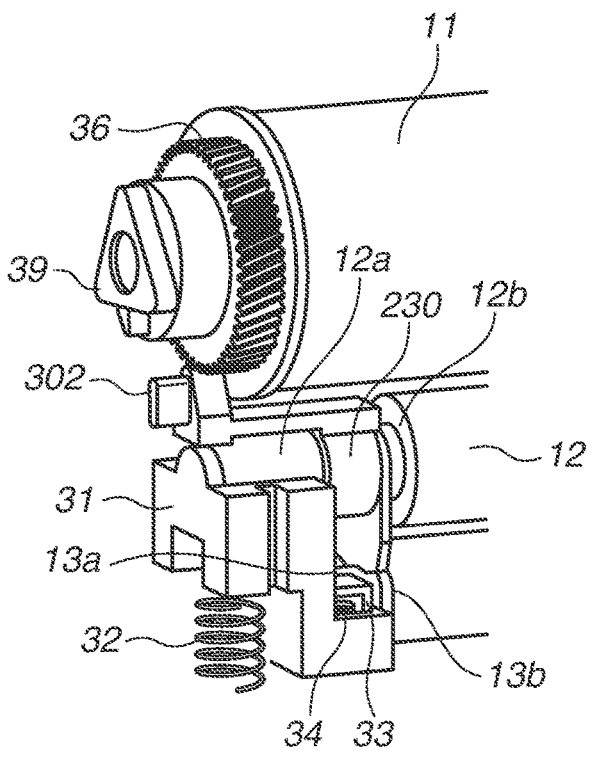
FIGS. 9A and 9B are partial perspective views respectively illustrating the separation state of the drum unit with the frame being omitted, and a photosensitive drum and the frame, according to the first exemplary embodiment.

According to the present exemplary embodiment, the regulation unit 300 includes an abutting portion 302 provided on the separation member 200 and an abutted portion 301 provided on the drum container 30 as illustrated in FIG. 8. The abutting portion 302 is provided to protrude from an end surface of the separation maintaining portion 210 in the rotating axis direction of the photosensitive drum 11 as illustrated in FIG. 9A. Thus, the abutting portion 302 is provided on the outside of the photosensitive drum 11 in the rotating axis direction.

Figure 9B:
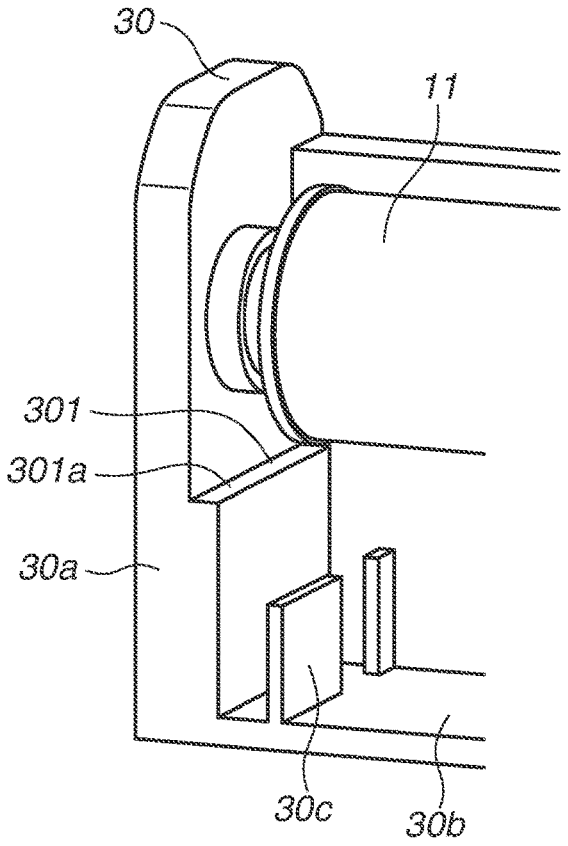

The abutted portion 301 is provided on the side wall 30*a* of the drum container 30 facing the end portion of the photosensitive drum 11 in the rotating axis direction as illustrated in FIG. 9B. More specifically, the abutted portion 301 is formed in such a manner that a portion of a side surface of the side wall 30*a* on the charging roller 12 side of a portion facing the end portion of the photosensitive drum 11 in the rotating axis direction is protruded inward (charging roller 12 side) with respect to the rotating axis direction. The above-described abutted portion 301 is formed so that the abutting portion 302 abuts thereon in a case where the separation member 200 moves in the direction in which the distance between the swing center of the separation member 200 and the rotation center of the gear 36 increases in a state in which the engagement portion 211 engages with the gear 36.

Thus, the abutted portion 301 includes an abutting surface 301*a* on which the abutting portion 302 abuts. The abutting surface 301*a* is formed on a side on which the separation member 200 moves in the direction in which the distance between the swing center of the separation member 200 and the rotation center of the gear 36 increases with respect to the abutting portion 302 in a case where the separation member 200 is in the separation maintaining state. The separation member 200 is provided to be freely swingable with respect to the rotating shaft 12*a* of the charging roller 12, and the swing center of the separation member 200 substantially coincides with the rotation center of the charging roller 12. Further, the charging roller 12 is urged toward the photosensitive drum 11 by the pressing spring 32, and the separation maintaining portion 210 of the separation member 200 is sandwiched between the rotating shaft 12*a* of the charging roller 12 and the gear 36 by the urging force of the pressing spring 32.

Thus, in the present exemplary embodiment, the side on which the separation member 200 moves in the direction in which the distance between the swing center of the separation member 200 (rotation center of the charging roller 12) and the rotation center of the gear 36 (rotation center of the photosensitive drum 11) increases is in an opposite direction of the urging direction of the pressing spring 32. Accordingly, the abutting surface 301*a* is located in the opposite direction of the urging direction of the pressing spring 32 with respect to the abutting portion 302 in a case where the separation member 200 is in the separation maintaining state. Thus, the abutting portion 302 abuts on the abutting surface 301*a*, and the separation member 200 is regulated from moving in the direction away from the gear 36 against the urging force of the pressing spring 32.

Figure 10B:
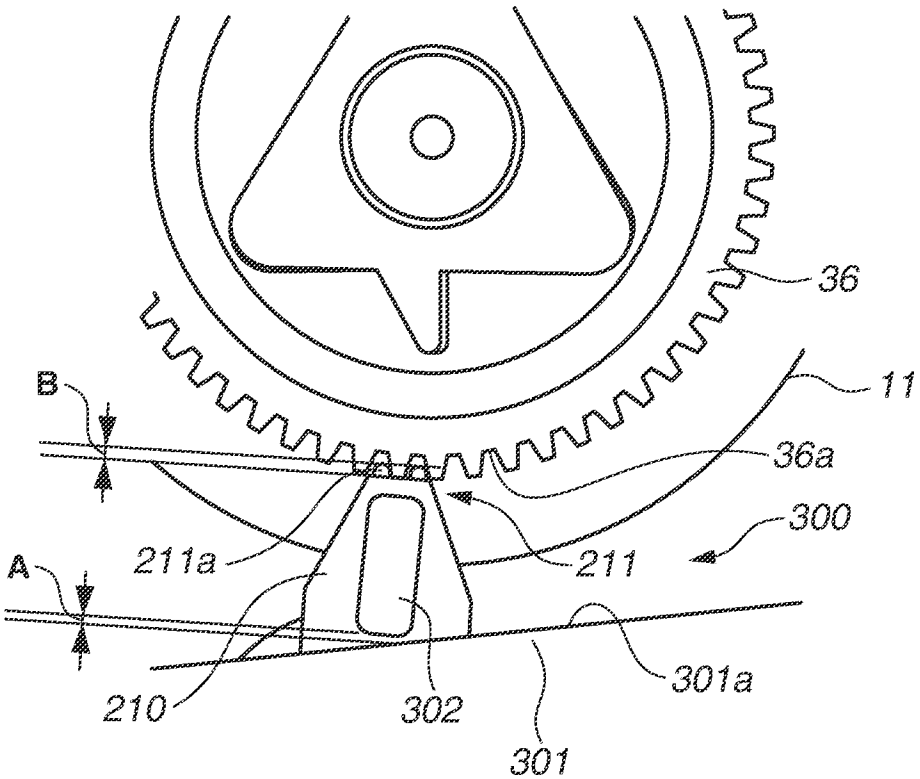
FIGS. 10A and 10B respectively are a partial side view illustrating the separation state of the drum unit, and a cross-section view along a line X-X in FIG. 10A, according to the first exemplary embodiment.
Figure 10A:
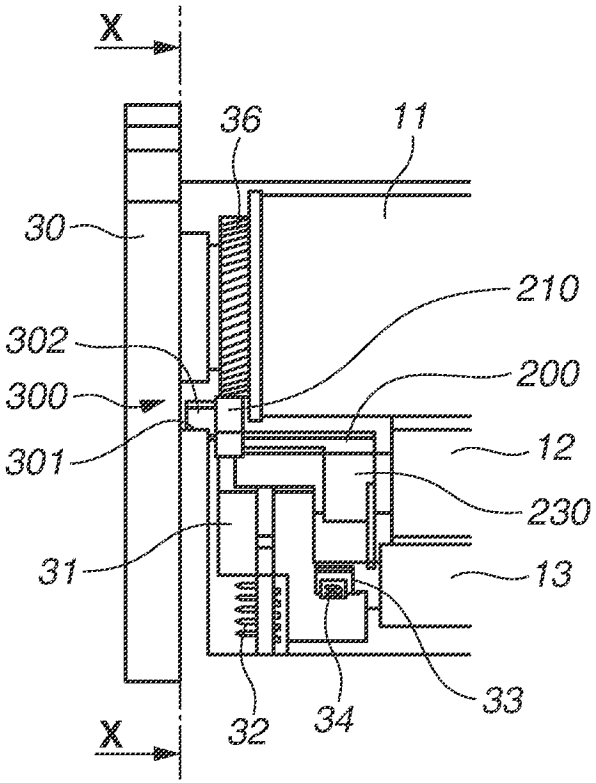

As illustrated in FIGS. 10A and 10B, a distance between the abutting portion 302 and the abutted portion 301 in the separation maintaining state and in a state where the separation member 200 does not move in the direction in which the distance between the swing center of the separation member 200 and the rotation center of the gear 36 increases, is defined as a distance A. It is desirable that the distance A is larger than zero. In other words, it is desirable that there is a gap between the abutting portion 302 and the abutted portion 301 in the above-described state. The separation maintaining state is a state where the separation member 200 maintains the charging roller 12 at the separation position. Further, the state where the separation member 200 does not move in the direction in which the distance between the swing center of the separation member 200 and the rotation center of the gear 36 increases is a state where the separation maintaining portion 210 of the separation member 200 is pressed against the gear 36 and is not separated from the gear 36. In this state, the distance A is smaller than a length (an engagement amount B, also referred to as a distance B) in which the gear teeth 211*a* and the engagement concave portion 36*a* overlap with each other with respect to a protrusion direction of the gear teeth 211*a* when it is viewed from a rotation direction of the gear 36.

In other words, as illustrated in FIGS. 10A and 10B, a relationship between the distance A between the abutting portion 302 and the abutting surface 301*a* in the separation maintaining state and the engagement amount B between the gear 36 and the engagement portion 211 is that the distance A is smaller than the engagement amount B in the slide direction of the charging roller bearing 31 (the direction in which the charging roller bearing 31 is guided along the slide guide portion 30*c*). In other words, a condition A<B is satisfied. With this configuration, the separation member 200 is regulated from moving in the direction in which the distance between the swing center of the separation member 200 and the rotation center of the gear 36 increases so that the engagement portion 211 and the gear 36 are not disengaged in the state where the engagement portion 211 engages with the gear 36.

For example, there is a possibility that the charging roller 12 moves in the direction away from the photosensitive drum 11 against the urging force of the pressing spring 32 caused by a vibration and a fall during the transportation of the drum cartridge 100. In this case, the separation member 200 supported on the rotating shaft of the charging roller 12 also moves in the direction away from the photosensitive drum 11. However, since the distance A is smaller than the engagement amount B as described above, the abutting portion 302 abuts on the abutted portion 301 before the engagement portion 211 and the gear 36 are disengaged and regulates the movement of the separation member 200, so that the separation maintaining state is prevented from being released.

In a case where the separation maintaining state is released, the gear 36 rotates together with the photosensitive drum 11, and the separation member 200 is swung, so that the engagement portion 211 and the gear 36 are disengaged. At that time, the separation member 200 is urged together with the charging roller 12 toward the photosensitive drum 11 by the pressing spring 32 and thus is moved to the photosensitive drum 11 side following the disengagement of the engagement portion 211 and the gear 36. In other words, the abutting portion 302 provided on the separation member 200 moves in a direction away from the abutted portion 301 while the separation member 200 swings. In this way, the separation member 200 swings, and the separation maintaining state is released without the abutting portion 302 interfering with the abutted portion 301.

According to the present exemplary embodiment, the separation member 200 is regulated from rotating in the opposite direction to the rotation direction (predetermined direction $\alpha$) in which the separation maintaining state is automatically released from the position in the separation maintaining state in a state where the abutting portion 302 abuts on the abutted portion 301. Thus, as illustrated in FIG. 11A, the abutted portion 301 is formed so that a drag P in a normal direction exerting on the abutting portion 302 acts in a direction in which the separation member 200 is swung in the opposite direction to the predetermined direction $\alpha$ in a case where the abutted portion 301 abuts on the abutting portion 302.

Figure 11B:
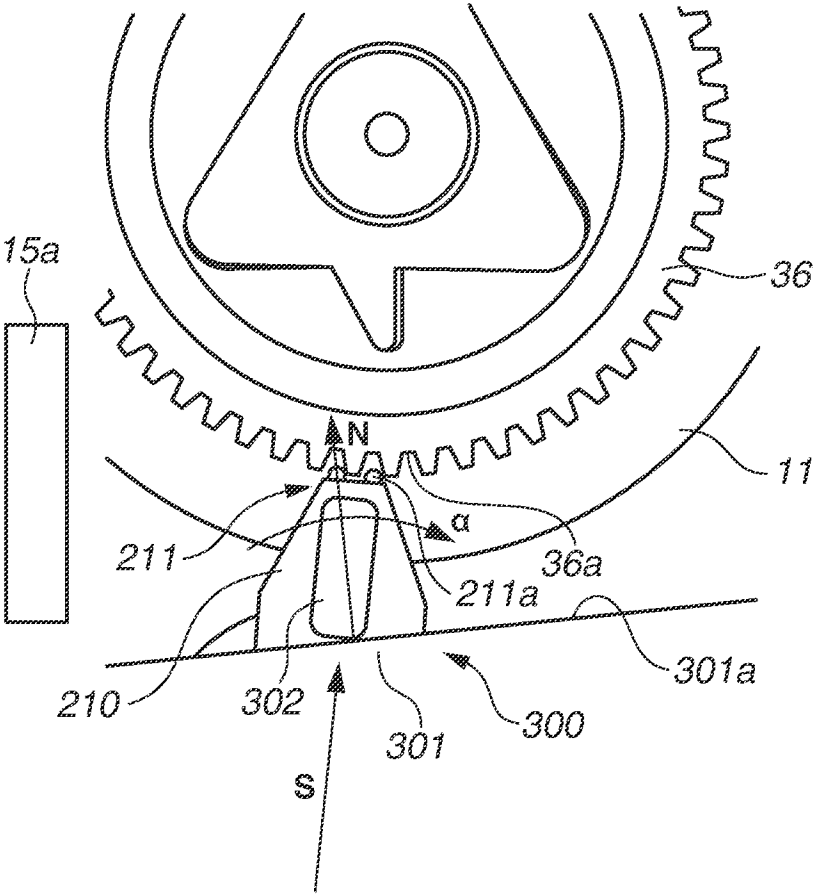
FIGS. 11A and 11B are cross-section views similar to FIG. 10B respectively illustrating a direction of torque acting in a case where an abutting portion abuts on an abutted portion and a relationship between an urging direction acting on a separation member and a normal vector of the abutting portion, according to the first exemplary embodiment.
Figure 11A:
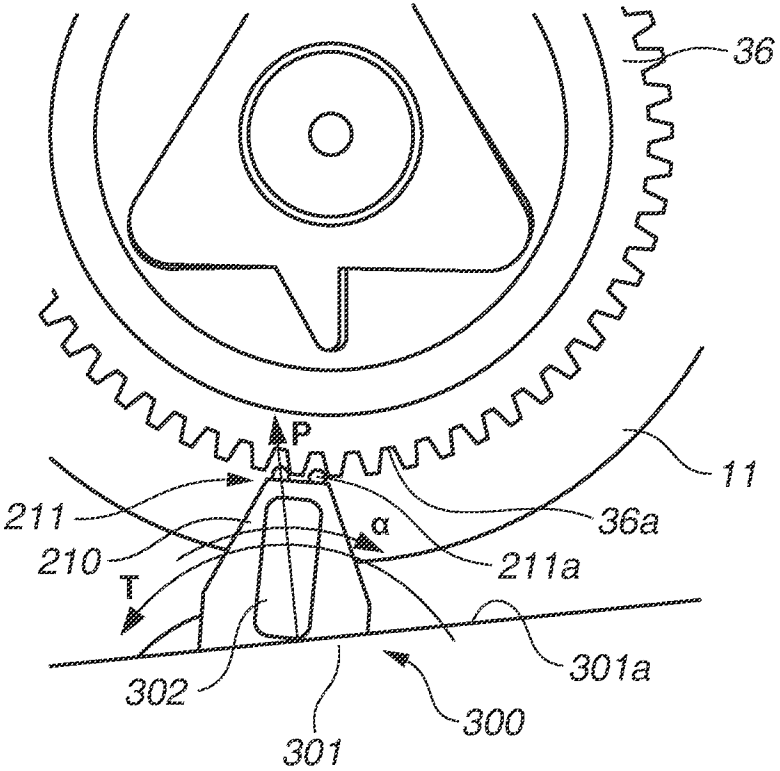

According to the present exemplary embodiment, as illustrated in FIG. 11B, the abutting surface 301*a* of the abutted portion 301 is inclined in the opposite direction to the predetermined direction $\alpha$ with respect to a direction orthogonal to an urging direction S of the pressing spring 32 (see FIG. 9A and the like). In other words, the abutting surface 301*a* includes a surface inclined with respect to the slide direction of the charging roller bearing 31.

The configuration is described specifically. The abutting surface 301*a* is an inclined surface in which the drag P in the normal direction exerting on the abutting portion 302 includes a force component for rotating the separation member 200 in the opposite direction to the rotation direction of the separation member 200 (the predetermined direction $\alpha$) at the time of automatic release in a case where the abutting surface 301*a* comes into contact with the abutting portion 302. In other words, the drag P in the normal direction generates torque T to rotate the separation member 200 in the opposite direction to the predetermined direction $\alpha$ as illustrated in FIG. 11A.

According to the present exemplary embodiment, as illustrated in FIG. 11B, the normal direction N of the abutting surface 301*a* is directed to the cleaning blade 15*a* side in the slide direction of the charging roller bearing 31 rather than the direction toward the rotating axis line of the photosensitive drum 11 (i.e., the urging direction S). The cleaning blade 15*a* abuts on the photosensitive drum 11 in the counter direction with respect to the rotation direction of the photosensitive drum 11 as illustrated in FIG. 2. Further, the cleaning blade 15*a* is arranged on an upstream side of the charging roller 12 in the rotation direction of the photosensitive drum 11 in order to clean the surface of the photosensitive drum 11 before charging the photosensitive drum 11. The photosensitive drum 11 rotates in the rotation direction β, and thus the separation member 200 swings in the predetermined direction α. Thus, the cleaning blade 15*a* is located on the opposite direction of the predetermined direction α with respect to the separation member 200. Accordingly, according to the present exemplary embodiment, the normal direction N of the abutting surface 301*a* is directed toward the cleaning blade 15*a* side rather than the urging direction S.

In a case where a large impact is applied to the drum cartridge 100 during the transportation of the drum cartridge 100, there is a possibility that a following issue occurs. Specifically, the relationship between the distance A between the abutting portion 302 and the abutting surface 301*a* in the separation maintaining state and the engagement amount B between the gear 36 and the engagement portion 211 may be reversed from the above-described relationship due to deformation of the drum container 30 and the like. In other words, there is a possibility that the condition may be A>B.

However, the abutting surface 301*a* is inclined as described above, so that it is possible to prevent the separation maintaining state from being accidentally released even if, for example, the condition becomes A>B, and the gear 36 and the engagement portion 211 are temporarily separated from each other. More specifically, if the separation member 200 is moved by an impact, and the abutting portion 302 comes into contact with the abutting surface 301*a*, the drag P in the normal direction for rotating in the opposite direction to the rotation direction of the separation member 200 (predetermined direction α) at the time of automatic release is generated at the abutting portion 302. Accordingly, the separation member 200 is prevented from rotating in the predetermined direction α, and even if the condition becomes A>B, the separation maintaining state can be prevented from being released.

Figure 13:
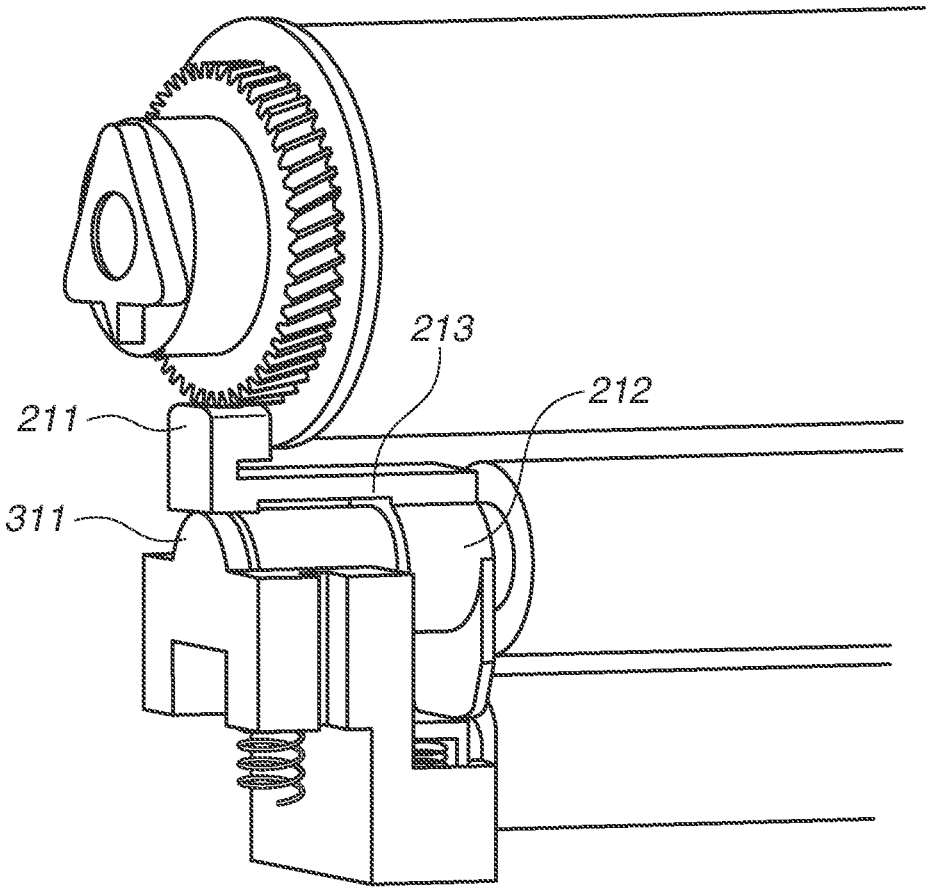
FIG. 13 is a perspective view of the separation maintaining portion according to the first exemplary embodiment.
Figure 14A:
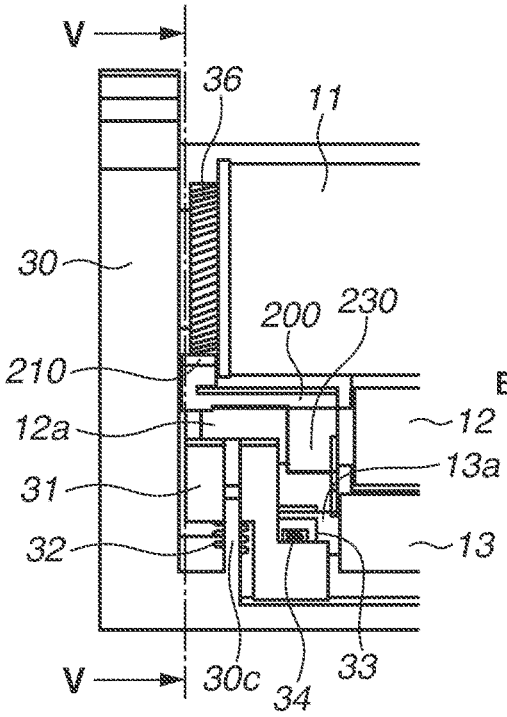
FIGS. 14A and 14B are cross-sectional views illustrating a modification example of the first exemplary embodiment.
Figure 14B:
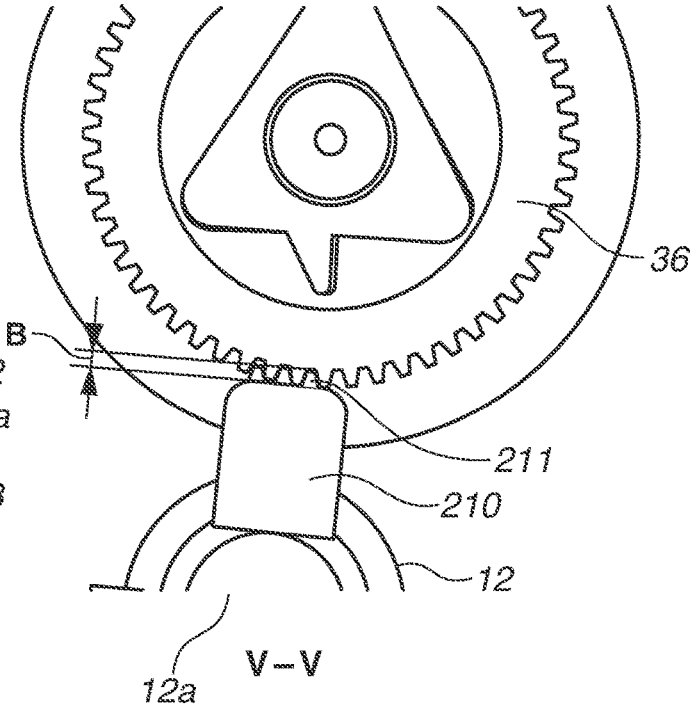
Figure 15A:
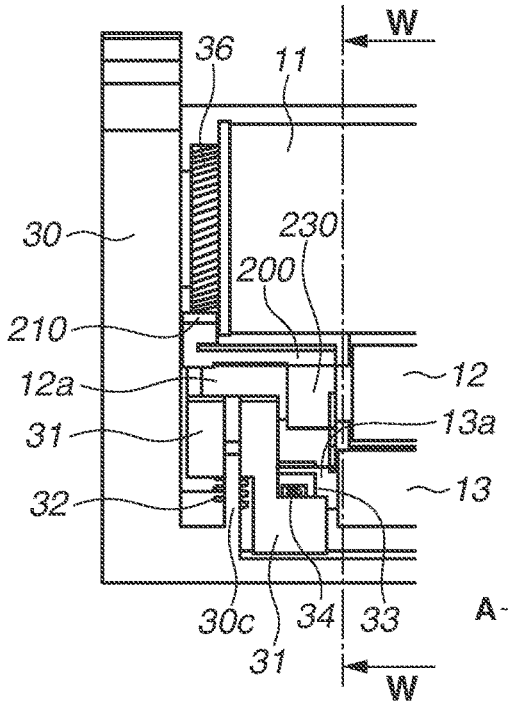
FIGS. 15A and 15B are cross-sectional views illustrating a modification example of the first exemplary embodiment.
Figure 15B:
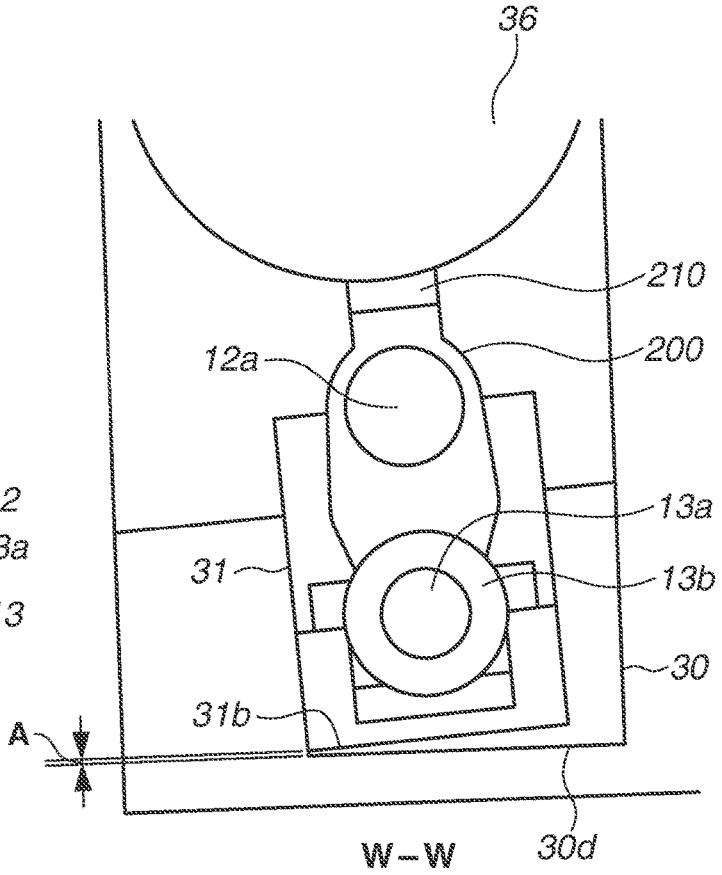

A feature of the present disclosure is a configuration for preventing the separation maintaining state from being released in addition to the above-described configuration (the separation member 200 is provided with the abutting portion 302, and the abutting portion 302 of the separation member 200 abuts on the abutted portion 301 of the drum container 30). The present disclosure may include a modification that can prevent the separation maintaining state from being released by including a configuration described below even if the separation member 200 is not provided with the abutting portion 302. According to the present exemplary embodiment, as illustrated in FIG. 13, the separation member 200 includes a supported portion 212 supported by a core metal of the charging roller 12 and a connection portion 213 (extension portion) extending from the supported portion 212 along the core metal of the charging roller 12 and connects the supported portion 212 and the engagement portion 211. If a length of the connection portion 213 is long, the connection portion 213 tends to bend starting from the supported portion 212. If an external force is applied to the photosensitive member unit 100, the connection portion 213 may bend in a direction in which the engagement portion 211 moves away from the gear 36. Accordingly, there is a possibility that the engagement portion 211 and the gear 36 may be disengaged. In order to prevent the above-described issue, a protrusion portion 311 protruding from the charging roller bearing 31 abuts on a surface of the separation maintaining portion 210 on an opposite side (opposite surface) of the gear 36 in the urging direction of the pressing spring 32 (first urging member) in the separation maintaining state. The protrusion portion 311 is a part of the charging roller bearing 31. According to the present exemplary embodiment, a configuration of the protrusion portion 311 has a shape protruding from the charging roller bearing 31 but is not limited to the protruding shape. The protrusion portion 311 may be configured to abut on the separation maintaining portion 210 even if the protrusion portion 311 is not configured to partially protrude from the charging roller bearing 31. This configuration can prevent the separation maintaining portion 210 from being separated from the gear 36 in a case where a vibration and an impact is applied to the drum cartridge 100, and the separation maintaining portion 210 is momentarily deformed. This configuration can prevent the separation maintaining portion 210 from being separated from the gear 36 in a case where a vibration and an impact is applied to the drum cartridge 100 even if rigidity of the separation maintaining portion 210 is low.

Figure 12:
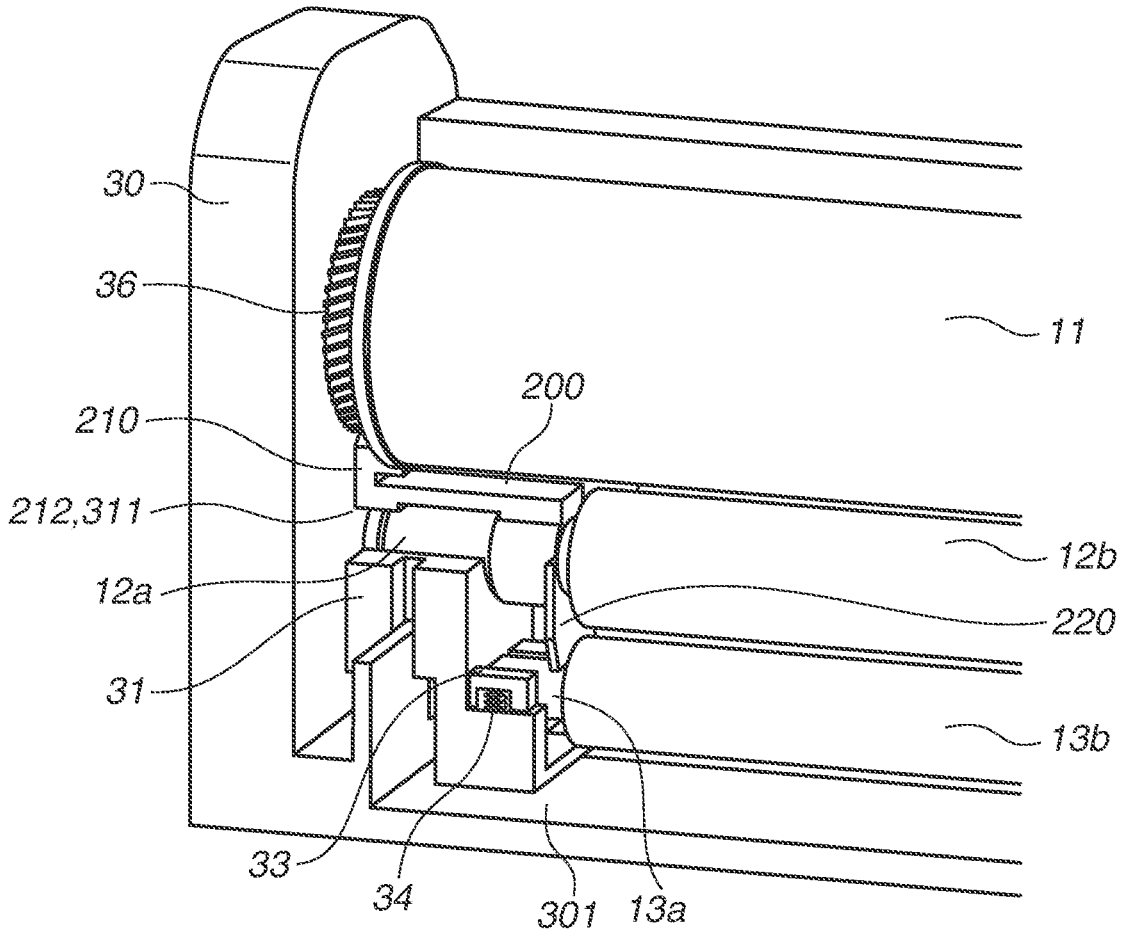
FIG. 12 is a perspective view of a separation maintaining portion according to the first exemplary embodiment.

The configuration of the protrusion portion 311 is described with reference to FIGS. 11A, 11B, and 12. FIGS. 11A and 11B are perspective views of the drum cartridge 100. The protrusion portion 311 forms a part of the charging roller bearing 31 and is provided on the outside of the charging roller 12 in the rotating axis direction of the charging roller 12. In other words, the protrusion portion 311 is integrally molded with the charging roller bearing 31. FIG. 12 illustrates a relationship between the protrusion portion 311 and the separation maintaining portion 210 in the separation maintaining state. According to the present exemplary embodiment, in a case where the engagement portion 211 engages with the gear 36, and the charging roller 12 is separated from the photosensitive drum 11 (separation state), the protrusion portion 311 is in a state of abutting on the separation maintaining portion 210.

With the configuration in which the protrusion portion 311 presses the separation maintaining portion 210 by the urging force of the pressing spring 32, even if an impact is applied, and the engagement portion 211 receives a force in a direction away from the gear 36, the engagement portion 211 can be prevented from being disengaged. On the other hand, according to the present exemplary embodiment, a portion of the protrusion portion 311 that comes into contact with the separation maintaining portion 210 has an arc shape. The portion of the protrusion portion 311 that comes into contact with the separation maintaining portion 210 has the arc shape, so that a contact area between the protrusion portion 311 and the separation maintaining portion 210 at the time of rotation of the separation member 200 can be reduced, and the protrusion portion 311 can reduce a load on the rotation of the separation maintaining portion 210. In addition, it is desirable that at least a part of the protrusion portion 311 overlaps with the engagement portion 211 in the rotating axis direction of the charging roller 12. This configuration can prevent the engagement portion 211 from being separated from the gear 36. According to the present exemplary embodiment, the distance A is shorter than the distance B.

According to the present exemplary embodiment, in a case where the engagement portion engages with the gear, and the charging roller is separated from the photosensitive drum 11 (separation state), the protrusion portion 311 is arranged to abut on the separation maintaining portion 210. The present exemplary embodiment can include a following configuration as other configurations. Specifically, the protrusion portion 311 is arranged with a gap having a distance (a shortest distance) with respect to the separation maintaining portion 210 in the separation state. The shortest distance between the protrusion portion 311 in the separation state and the separation maintaining portion 210 is shorter than the above-described distance B (engagement amount between the engagement portion 211 and the gear 36). With this configuration, even if an impact is applied, and the engagement portion 211 receives a force in the direction away from the gear 36 and moves in the direction away from the gear 36, the separation maintaining portion 210 abuts on the protrusion portion 311 and can prevent the engagement portion 211 from being disengaged from the gear 36. The shortest distance between the protrusion portion 311 in the separation state and the separation maintaining portion 210 is shorter than the distance B. Even with this configuration, an effect equivalent to the above-described configuration can be obtained.

According to the present exemplary embodiment, the protrusion portion 311 has the arc shape, but may have another configuration in which a width becomes smaller as it approaches the photosensitive drum 11 without being limited to the arc shape.

According to the present exemplary embodiment, a plate-shaped protrusion portion protruding from the side wall 30*a* of the drum container 30 is provided as a regulation unit. However, a side wall 30*d* of the drum container 30 may serve as the regulation unit as illustrated in FIGS. 14A, 14B, 15A and 15B. More specifically, as illustrated in FIGS. 14A, 14B, 15A and 15B, an end surface 31*b* of the charging roller bearing 31 serves as the abutting portion 302, and the side wall 30*d* of the drum container 30 serves as the abutted portion 301. Further, in a case where the separation member 200 moves in the direction in which the distance between the swing center of the separation member 200 and the rotation center of the gear 36 increases (the direction in which the charging roller bearing 31 is guided along the slide guide portion 30*c*) in the state where the engagement portion 211 engages with the gear 36 (the separation maintaining state in FIGS. 15A and 15B), the abutting portion 302 (the end surface 31*b* of the charging roller bearing 31) is formed to abut on the abutted portion 301 (the side wall 30*d* of the drum container 30). Even with this configuration, it is desirable that the engagement amount B between the gear 36 and the engagement portion 211 in FIGS. 14A and 14B (a length in which the engagement portion 211 engages with the gear 36) has a relationship larger than the distance A (shortest distance) between the abutting portion 302 (the end surface 31*b* of the charging roller bearing 31) and the abutted portion 301 (the side wall 30*d* of the drum container 30) in the separation maintaining state in FIGS. 15A and 15B.

As described above, even in a case where a vibration and an impact is applied to the drum cartridge 100, and a force for moving the separation maintaining portion 210 in the direction away from the gear 36 is applied, the engagement portion 211 and the gear 36 can be prevented from being disengaged. Accordingly, it is possible to reduce an event in which the separation maintaining state between the photosensitive drum 11 and the charging roller 12 and further the separation maintaining state between the charging roller 12 and the cleaning roller 13 are accidentally released.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-196418, filed Nov. 26, 2020, and Japanese Patent Application No. 2021-154031, filed Sep. 22, 2021, which are hereby incorporated by reference herein in their entirety.

What is claimed is:

1. A photosensitive member unit mountable onto an image forming apparatus, the photosensitive member unit comprising:

a photosensitive member that is rotatable;

a charging roller that is rotatable and configured to charge the photosensitive member by coming into contact with the photosensitive member;

a charging roller bearing member attached to a rotating shaft of the charging roller and rotatably supporting the charging roller;

an urging member arranged on the charging roller bearing member to urge the charging roller toward the photosensitive member;

a gear arranged on an end portion of the photosensitive member in a rotating axis direction;

a separation member arranged on the rotating shaft of the charging roller, including an engagement portion to engage with the gear, and configured to separate the charging roller and the photosensitive member;

a guide portion configured to guide the charging roller bearing member urged by the urging member so that the charging roller is separated from the photosensitive member in a state where the engagement portion and the gear are engaged with each other and to guide the charging roller bearing member urged by the urging member so that the charging roller comes into contact with the photosensitive member in a state where the engagement portion and the gear are not engaged with each other; and a frame configured to support the photosensitive member, wherein A<B is satisfied, where A is a shortest distance between the charging roller bearing member urged by the urging member and the frame in the state where the engagement portion and the gear are engaged with each other, and B is an engagement amount between the engagement portion and the gear in the state where the engagement portion and the gear are engaged with each other.

2. The photosensitive member unit according to claim 1, further comprising:

a cleaning roller that is rotatable and configured to clean the charging roller by coming into contact with the charging roller;

a cleaning roller bearing member attached to a rotating shaft of the cleaning roller and rotatably supporting the cleaning roller;

a second urging member arranged on the cleaning roller bearing member and configured to urge the cleaning roller toward the charging roller; and a second guide portion configured to guide the cleaning roller bearing member urged by the second urging member so that the cleaning roller is separated from the charging roller in the state where the engagement portion and the gear are engaged with each other, and to guide the cleaning roller bearing member urged by the second urging member so that the cleaning roller comes into contact with the charging roller in the state where the engagement portion and the gear are not engaged with each other.

3. The photosensitive member unit according to claim 1, further comprising a driving force receiving portion configured to receive a driving force for rotating the photosensitive member, wherein the state where the engagement portion and the gear are engaged with each other is shifted to the state where the engagement portion and the gear are not engaged with each other when the gear is rotated by receiving the driving force by the driving force receiving portion in the state where the engagement portion and the gear are engaged with each other.

* * * * *